United States Patent [19]

Huber et al.

[11] Patent Number: 4,706,318

[45] Date of Patent: Nov. 17, 1987

[54] JOINT COVERING FOR EXPANSION JOINTS IN CARRIAGEWAYS, ESPECIALLY BRIDGES

[76] Inventors: Reinhold Huber, Winzerweg 21, CH-8180 Bulach, Switzerland; Waldemar Koster, Im Tentefeld 17, D-5062 Forsbach, Fed. Rep. of Germany

[21] Appl. No.: 693,852

[22] Filed: Jan. 23, 1985

[30] Foreign Application Priority Data

Jan. 23, 1984 [EP] European Pat. Off. ..... 84100680.2

[51] Int. Cl.[4] ..... E01D 19/06

[52] U.S. Cl. ..... 14/16.5; 404/67; 404/69

[58] Field of Search ..... 404/47, 48, 56, 67, 404/68, 69; 52/396; 14/16.5

[56] References Cited

U.S. PATENT DOCUMENTS

| | | | |
|---|---|---|---|
| 3,165,986 | 1/1965 | Hirst et al. | 404/47 |
| 3,363,522 | 1/1968 | Galbreath | 14/16.5 X |
| 3,375,763 | 4/1968 | Welch | 404/67 |
| 3,439,592 | 4/1969 | McAusland | 404/66 |
| 3,520,236 | 7/1970 | Sequaris | 14/16.5 X |
| 4,111,582 | 9/1978 | Tippett | 14/16.5 X |
| 4,279,533 | 7/1981 | Peterson et al. | 404/68 |
| 4,504,170 | 3/1985 | Schukolinski | 404/69 X |

FOREIGN PATENT DOCUMENTS

| | | | |
|---|---|---|---|
| 86277 | 8/1983 | European Pat. Off. | 404/69 |
| 2464341 | 3/1981 | France | 52/396 |

*Primary Examiner*—James A. Leppink
*Assistant Examiner*—Matthew Smith
*Attorney, Agent, or Firm*—George E. Kersey

[57] ABSTRACT

A joint covering has an elastic mat that is cast in situ and lies on rigid plates bridge the gap. The plates are controlled by providing the mat with elastomeric projections on its underside which engage the plates. The elastic behavior of the mat is not impaired in any way as a result.

9 Claims, 10 Drawing Figures

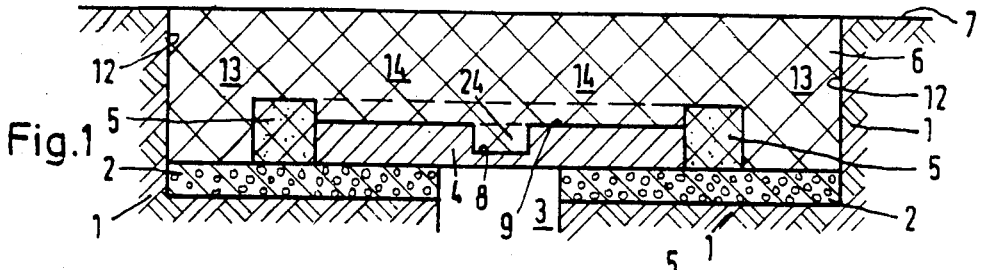
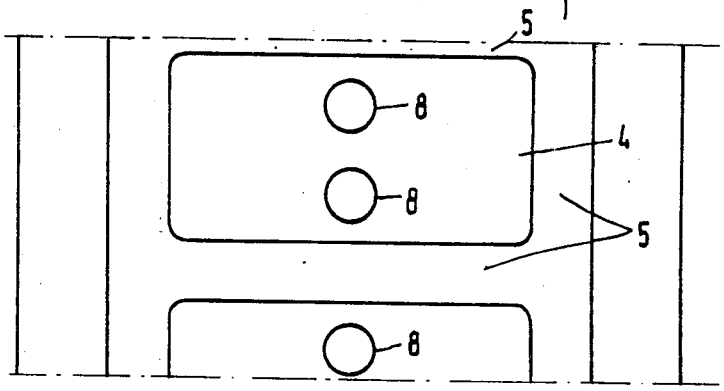
Fig.2
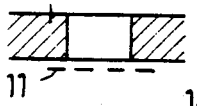
Fig.3
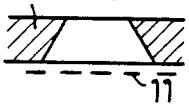
Fig.4
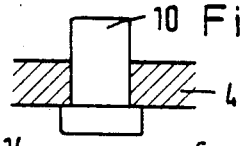
Fig.5
Fig.6
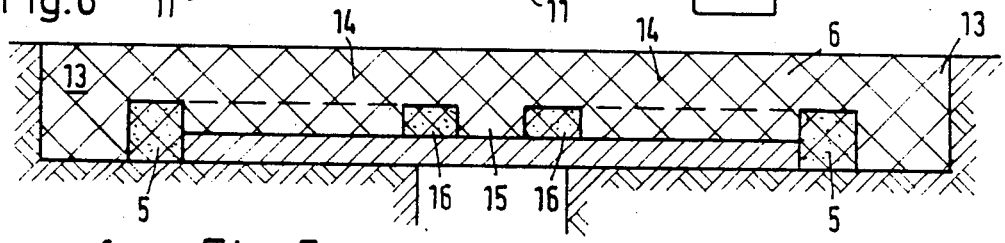
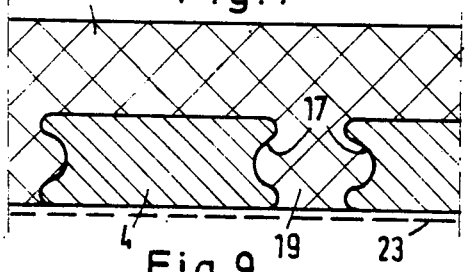
Fig.7
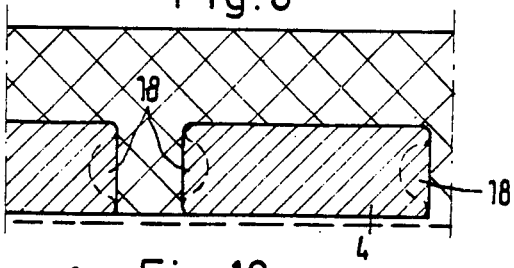
Fig.8
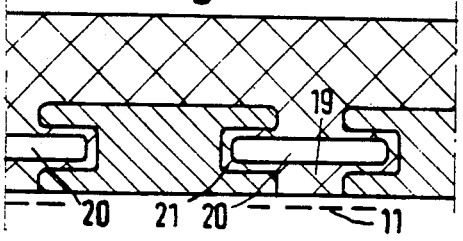
Fig.9
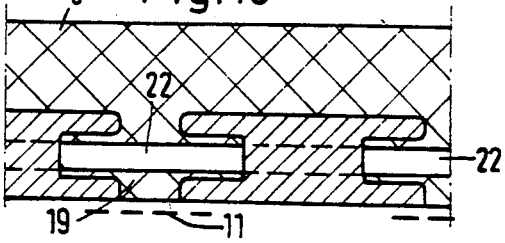
Fig.10

JOINT COVERING FOR EXPANSION JOINTS IN CARRIAGEWAYS, ESPECIALLY BRIDGES

BACKGROUND OF THE INVENTION

The invention relates to a joint covering for expansion joints in carriageways, especially bridges, which lies flush with the surface of the carriageway and has an elastomeric mat which, by a central strip, lies loosely on plates that bridge the joint, are placed at intervals next to one another on the edges of the joint and consist of a rigid material, and which is connected by two edge strips to the edges of the joint, each of the plates being secured at least at one place to the underside of the mat.

A joint covering of this type is described in European Patent Application EP No. 82 112036.7. That application relates to a joint which is composed of prefabricated components. Such a construction is economically unacceptable for narrow joints and in the case of broad joints adjustment to the particular structural conditions may present difficulties.

A joint which is likewise prefabricated is described in Belgian Patent Specification No. 695 015. In its embodiment according to FIG. 1, an elastomeric mat is anchored in the region of the edges of the joint and is connected to the metal plates bridging the joint only in the centre at its underside. A disadvantage in this case is that this connection in which the anchoring means engages the mat interferes with the elasticity of the mat. In addiion, the mat is supported only at a few places along its cross-section, as a result of which considerable wear must be anticipated.

SUMMARY OF THE INVENTION

In contrast, the problem underlying the present invention is to provide a joint covering that is cast in situ and in which the plates bridging the joint are held down and controlled centrally with respect to the joint gap by the mat itself without the elastic behaviour of the mat being impaired thereby.

According to the invention, this problem is solved in the case of a construction of the type mentioned at the beginning by casting the elastomeric mat in situ and by providing as fastening means at the fastening place an elastomeric projection on the underside of the mat which engages the plate directly or indirectly or adheres to the surface thereof.

The projection can engage a cut-away portion, opening or recess in the plate or be formed by a cross-piece between two adjacent plates which engages lateral indentations in these plates.

It is also possible for such a cross-piece to engage indirectly, namely by sliding bolts anchored therein and projecting on both sides beyond the surface of the cross-piece, in lateral grooves of adjacent plates.

In that case the projection is preferably produced simultaneously with casting of the mat, that is to say as a part of the mat; it would also be possible to prefabricate a plug from elastomeric material which, during casting of the mat, would connect with the latter to form an integral component.

The proposal of the invention ensures a mat that is not subject to the disturbing engagement of fastening means, that is to say a mat is cast which has a uniform elastic behaviour over its entire thickness and its entire width. To a certain extent, the fastening means lie outside the mat member responsible for the elasticity of the mat and in addition they have the same elastomeric properties as the mat itself. As a result of being manufactured in situ, the mat is especially well adapted to the edges of the joint. It is not possible for either tipping up or directional changes of the edges of the joint to result in difficulties, as is often the case, in contrast, in prefabricated joint coverings. With the joint covering according to the invention, a mechanical anchoring of the elastomeric mat in the edge region in superfluous; as a result of the casting, the mat is rigidly connected in the region of its edge strips to the recesses of the carriageway forming the edges of the joint. Since, in addition, the mat is manufactured without stress in situ, the danger of arching of the mat when the joint narrows is largely overcome. In order to be entirely reliable in this respect, it may be advantageous for the mat to have a cavity running in the longitudinal direction of the joint along each of the two ends of the plates, the height of which exceeds the thickness of the plate. Depending on the manufacturing conditions, both this cavity and the spaces between the plates are filled with one or more intermediate layers of foamed plastics material. After being placed in position, a joint covering formed from such intermediate layers and plates is covered with mat material. The cavities mentioned are thus formed and their shape ensures that under horizontal compression the central strips of the mat are pressed in the direction of the joint gap.

In the case of relatively wide expansion joints, it is advantageous to secure the mats additionally against arching owing to narrowing of the joint. Suitable for this purpose is a bar which is placed in the centre of the joint in the longitudinal direction of the joint and on which the plates are threaded.

BRIEF DESCRIPTION OF THE DRAWINGS

FIG. 1 shows a vertical cross-section through a joint covering for narrow joints;

FIG. 2 shows a plan view of the joint covering according to FIG. 1 without a mat;

FIGS. 3–5 each shows different fastening means for connecting the mat to the plates lying underneath;

FIG. 6 shows a vertical section through a joint covering for expansion joints of medium size;

FIGS. 7 and 8 each shows a vertical partial section in the longitudinal direction of a wider joint, the plates being cut eccentrically in FIG. 7 and centrally in FIG. 8, and FIGS. 9 and 10 each shows a vertical section in the longitudinal direction of a joint covering further developed from FIGS. 7/8, the plates being cut eccentrically in FIG. 9 and approximately centrally in FIG. 10.

DETAILED DESCRIPTION OF THE INVENTION

According to FIG. 1 the edges 1 of the joint are shown by cut-away portions in a concrete carriageway, the horizontal faces of the cut-away portions on each side being provided with a layer 2 of elastomeric concrete.

The layers 2 of elastomeric concrete on each side form the substrate for the plates 4 which bridge the joint gap 3, are arranged at intervals in the longitudinal direction of the joint and consist of a rigid material, preferably metal or a plastics material that is resistant to bending, such as, for example, GRP (glass-fibre reinforced plastics material).

As shown in FIG. 2, the plates 4 are placed in recesses of an intermediate layer 5 of foamed plastics material. The intermediate layer 5 has openings into which the plates 4 are inserted before the whole is cast with an elastomer, such as, for example, polyurethane, so that an elastomeric mat 6 is formed, the upper side of which is flush with the carriageway 7. In order that the plates 4 are always maintained centrally with respect to the joint gap 3, a connection is provided between the mat 6 and the plates 4. This is formed by filling two recesses 8 of each plate 4 with mat material. The projections so formed at the underside of the mat form elastomeric catches 24 for the plates 4. Instead of the recesses 8 in the upper side 9 of the plates 4, the latter may also have (not shown in the drawing) lateral cut-away portions or openings as shown in FIGS. 3 to 5. The opening is formed as a cylinder according to FIG. 3 and as a cone having a smaller upper opening according to FIG. 4. According to FIG. 5, there is pushed into a cylindrical opening an elastomeric bolt 10 which preferably consists of the mat material and joins itself to the mat 6 when the mat is cast. In order that the mat material does not pass into the joint gap 3 during casting, it is advantageous to seal the openings of the plates 4 according to FIGS. 3 and 4 on the underside of the mat by means of adhesive strips 11. The mat material forms a strong, insoluble connection on the one hand with the vertical edges 12 of the concrete of the carriageway and on the other hand with the adjacent surface of the layer 2 of elastomeric concrete. As a result, additional mechanical edge fastening means are superfluous. A central strip 14 of the mat 6 lies substantially on the plates 4, the upper side of which is provided with a separating layer (not shown) which excludes any connection between the mat 6 and the plates 4 and accordingly permits relative movement between the two components. Such a separating layer is obviously not present in the region of the recesses 8 or openings of the plates 4. The plates 4, for their part, are placed on the smoothed surface of the layers 2 of elastomeric concrete and are provided on their underside likewise with a separating layer.

The intermediate layer 5 of foamed plastics material has a greater thickness than the plates 4. As a result, starting from the edge strips 13 of the mat, a holding-down effect which is exerted on the central strips 14 is achieved when the mat 6 is subject to compression.

In the context of the solution described, it is important that relatively narrow plates 4 are used since plates that are too broad would be loose owing to the lack, in practice, of parallelism of the two edges of the joint. In that case, the spacing of the plates 4 from one another is so selected that the thickness of the mat is sufficient for distribution of the wheel loads. Owing to the two recesses 8 in each plate 4, the individual plates are secured with respect to the centre of the mat against displacement and twisting. The edges of the joint can be displaced normally and in parallel, sufficient room being provided for movement of the rigid plates 4 as a result of the foamed intermediate layers 5, while the mat 6 deforms in accordance with any change in the position of the joint.

FIG. 6 shows an adhesive connection between a mat 6 in the region of its central strip 14 and the plates 4. This adhesive connection is brought about by projections in the form of ribs 15 of the mat 6 which are formed between central, strip-shaped intermediate layers 16 of foamed plastics material which run in the longitudinal direction of the joint. This adhesive connection between the mat 6 and the plate 4 in the region of the ribs 15 prevents arching of the mat 6 when the joint narrows; owing to the elasticity of the mat 6 and the adhesive connection mentioned, the plates 4 are controlled with respect to the centre of the mat.

In the case of relatively large expansion joints, that is to say when there is great movement of the edges of the joint, it is not sufficient to secure the central strip 14 of the mat 6 against arching by means of projections on the underside of the mat; in this case it is also necessary to secure the mat over the entire width of the joint. For this purpose, according to FIG. 7, the spaces between the plates 4 are filled with mat material when the mat 6 is cast, projections in the shape of cross-pieces 19 being formed. The mat 6 is secured vertically by indentations 17 in the lateral flanks of the plates 4 without the longitudinal displacement of the plates 4 being impeded. A prerequisite in this case is also that the suface of the plates is provided with a separating layer, for example wax, which prevents an adhesive connection with the plates 4 during casting of the mat 6.

According to FIG. 8, which shows a central section through the plates 4, cams 18 are provided for delimiting the indentations 17 in the lateral flanks of the plates 4 which permit horizontal control of the displacement movement of the plates 4. On the underside of the plates 4 there is provided a plastics film which runs in the longitudinal direction of the joint, seals the joint covering towards the bottom during casting of the mat so that the mat material does not escape into the joint gap and, at the same time, forms a separating layer with respect to the layer 2 of elastomeric concrete in the region of the central strip 14 of the mat 6.

The embodiment according to FIGS. 9 and 10 has an especially effective means for securing against lift which prevents the combination of plates 4 and mat 6 from lifting upwards when the joint narrows considerably. According to FIG. 9, the mat 6, as already described with reference to FIGS. 7 and 8, is guided in the spaces between the plates 4 by cross-pieces 19. In addition, there are bedded into the cross-pieces 19 sliding bolts 20 which are arranged behind one another and which, with their opposed ends, engage grooves 21 of the lateral flanks of the plates 4. These sliding bolts 20 preferably consist of a rigid material having good slidability, for example polyamide, as do the plates 4. In the region between the sliding bolts 20, the grooves 21 are filled with foam so that, under pressure, the cross-pieces 19 can deform into the grooves 21 and jamming is therefore avoided.

FIG. 10 shows a bar 22 of relatively hard elastomer or rigid thermoplatcis material which is provided in addition to the sliding bolts 20 and is inserted through the centre of the mat. According to the representation in FIG. 10, the bar 22 runs parallel to the longitudinal direction of the joint. In this case also, it is possible to provide adhesive strips 11 running in the longitudinal direction of the joint to seal the spaces between the plates before casting the mat.

While preferred embodiments of the present invention have been described, it should be understood that various changes may be made therein without departing from the spirit and scope of the invention as defined by the appended claims.

What is claimed is:

1. Joint covering for expansion joints in carriageways, especially bridges, which lies flush with the surface of the carriageway, comprising plates that bridge the joint and are placed at intervals next to one another on the edges of the joint and consist of a rigid material, an elastomeric mat cast in situ, a central strip of said mat lying loosely on said plates, two edge strips of said mat connecting said mat to the edges of the joint, each said plate being secured at least at one place to the underside of said mat, and an elastomeric projection on the underside of said mat which engages said plate to secure each said plate at least at one place to the underside of said mat.

2. Joint covering according to claim 1, comprising a cross-piece between two adjacent said plates which forms said projection on said mat and wherein said plates define engaged by said cross-piece.

3. Joint covering according to claim 2, wherein said plates define grooves in lateral flanks thereof and which comprises laterally projecting sliding bolts that are anchored in said cross-piece and engage said grooves.

4. Joint covering according to claim 1, wherein each said plate defines at least one cut-away portion and which comprises a respective correspondingly shaped projection engaging in each said cut-away portion.

5. Joint covering according to claim 1, comprising a prefabricated elastomeric bolt connected to casting material for said mat to form said elastomeric projection.

6. Joint covering according to claim 1, wherein said mat defines a cavity along each of the two ends of said plates running in the longitudinal direction of the joint, the height of said cavity is somewhat greater than the thickness of a said plate.

7. Joint covering according to claim 6, comprising at least one intermediate layer of foamed plastics material filling said cavity.

8. Joint covering according to claim 7, comprising one or more intermediate layers of foamed plastics material filling the spaces between said plates.

9. Apparatus for providing a cover for an expansion joint, which comprises means, having a recess therein, for bridging the joint; and elastomeric means providing a locking projection into said recess, covering and holding the bridging means centrally with respect to the joint without impairing its elastic behavior.

* * * * *